US005991929A

United States Patent [19]

Imboden et al.

[11] Patent Number: 5,991,929

[45] Date of Patent: Nov. 30, 1999

[54] PANTY PANTYHOSE COMBINATION GARMENT AND METHOD FOR FORMING SAME

[75] Inventors: Walter H. Imboden, Burlington; Jonathan M. Myers, Winston-Salem, both of N.C.

[73] Assignee: Sara Lee Corporation, Winston-Salem, N.C.

[21] Appl. No.: 08/986,888

[22] Filed: Dec. 8, 1997

[51] Int. Cl.[6] ..... A41B 11/14

[52] U.S. Cl. ..... 2/409; 2/406; 66/177; 66/189

[58] Field of Search ..... 2/400, 402, 406, 2/409, 407, 239, 240, 401; 66/175, 176, 177, 178 R, 180, 178 A, 189

[56] References Cited

U.S. PATENT DOCUMENTS

| | | | |
|---|---|---|---|
| 3,449,932 | 6/1969 | Fillmore et al. | 66/177 |
| 3,824,812 | 7/1974 | Matthews et al. | 66/177 |
| 3,937,039 | 2/1976 | Anderson | 66/177 |
| 4,010,627 | 3/1977 | Pernick | 66/177 |
| 4,341,095 | 7/1982 | Poteat | 2/406 |
| 5,519,894 | 5/1996 | Imboden et al. | 2/409 |
| 5,787,732 | 8/1998 | Perron et al. | 66/177 |
| 5,832,013 | 10/1998 | Lonati et al. | 66/176 |

*Primary Examiner*—Amy B. Vanatta
*Attorney, Agent, or Firm*—Charles Y. Lackey; Kilpatrick Stockton LLP

[57] ABSTRACT

A circularly knit tubular hosiery member and garment formed therefrom and a method for producing both. The member has a first tubular portion with a lateral portion having a plurality of courses with short stitch lengths. The garment is formed from a pair of the members disposed in a side-by-side relationship, slit along a part of their length and joined at pairs of the edges thus formed to provide a panty section with front, rear and lateral portions. The lengths of the stitches in the courses in the lateral portions are shorter than the stitch lengths in the front and rear panty portions so that the panty section has an arcuately shaped leg profile within the lateral portions. The method includes forming the panty pantyhose combination garment from the two separate tubular members with the stitches in the courses of the lateral portions made smaller than the stitch lengths in the rear and front portions.

23 Claims, 3 Drawing Sheets

PANTY PANTYHOSE COMBINATION GARMENT AND METHOD FOR FORMING SAME

BACKGROUND OF THE INVENTION

1. Field of the Invention

This invention relates to a seamless knit hosiery blank, a garment formed thereby and a method of making the blank and garment having an arcuate leg panty line or profile.

2. Description of the Prior Art

Pantyhose and hosiery manufacturers have traditionally formed pantyhose garments with a panty portion having a heavier yarn so as to simulate an undergarment for the wearer which might possibly eliminate the need for separate panties when the garment is worn. The appearance of the garment, thusly constructed, is like that shown in U.S. Pat. No. 5,519,894. Such garments have panty sections that resemble trunks rather than a panties with arcuate leg profiles. This has traditionally been the only way to make conventional pantyhose with a single layer of yarn throughout the panty and leg portions to date.

It has been possible to manufacture pantyhose with the panty section having a somewhat curved leg profile by using an additional layer or layers of yarn which involves splicing and trimming the yarn at various locations. An example of this construction is shown in U.S. Pat. No. 4,010,627.

Thus, there has been a continuing demand for a single yarn layer panty and pantyhose combination garment having an arcuate panty profile to provide a more attractive and realistic combination garment. It is to this need and demand that the present invention is directed.

SUMMARY OF THE INVENTION

The present invention is for a circularly knit tubular hosiery member, a garment formed therefrom, and a method for making same.

The tubular member, sometimes referred to as a blank, has a first tubular portion made up of a multiplicity of courses of knitting forming a front portion, a rear portion, an outside portion, and a joining portion, each course of the first tubular portion having knitted stitches of predetermined lengths so that shorter stitch lengths appear in the outside portion and thereby raise or tighten the section to form the arcuate panty leg profile. A second tubular portion functions as the leg and foot portion of the member.

The panty pantyhose combination garment is formed from a pair of the circularly knit members disposed in a side-by-side relationship and slit at least along a part of their length and joined at pairs of the edges thus formed to provide a panty section with a front panty portion, a rear panty portion and two lateral portions, each positioned between the front panty portion and the rear panty portion. The panty front, rear and lateral portions have a multiplicity of courses of knitting, each of which has knitted stitches of predetermined lengths, the knitted stitch length in the lateral portions being shorter than the knitted stitch lengths in the front and rear panty portions so that the panty section has an arcuately shaped leg profile within the lateral portions.

The method of forming the panty pantyhose combination garment includes forming the two separate tubular members, each of which are formed by making a first tubular portion from a first yarn for encircling the waist and torso of the wearer with a multiplicity of courses of knitting forming a front portion, a rear portion, a lateral portion, and a joining portion with each course having knitted stitches of predetermined lengths. The stitches in each course are graduated so that the stitch lengths in the lateral portion are smaller than the stitch lengths in the rear, joining and front portions. The garment is finished by knitting the leg and feet portions in each of the tubes from a different yarn, thereafter slitting the tubular members along a portion of their length within the joining portions to form slit edges and joining the slit edges to form a pantyhose garment.

From this summary, it can be seen that a primary objective of the present invention is to provide a hosiery blank and garment made therefrom having a natural arcuately shaped panty leg profile simulating more realistically than ever before an actual panty and leg covering garment.

Another object of the present invention is to provide two mirror image formed circularly knit members which, when joined, form a panty portion and individual leg and foot portions.

Yet another object of the present invention is to provide a method of forming a knitted tubular member and a garment made therefrom by using a single layer of yarn throughout the panty, leg and foot portions while providing an arcuately shaped panty leg profile.

Still another object of the present invention is to provide a panty pantyhose combination garment utilizing two distinctly different yarns, the first for the panty portion and the other for the leg and foot portion so that two distinctly different items of apparel are simulated.

Thus, there has been outlined in summary form, the more important features of the invention in order that the detailed description that follows may be better understood and in order that the present contribution to the art may be better appreciated. There are obviously additional features of the invention that will be described hereinafter and which will form the subject matter of the claims appended hereto. It is to be understood that the invention is not limited in its application to the details of construction and to the arrangement of the components set forth in the following description or illustrated in the drawings.

The invention is capable of other embodiments and of being practiced and carried out in various ways. It is also to be understood that the phraseology and terminology herein are for the purpose of description and should not be regarded as limiting in any respect. Those skilled in the art will appreciate the concept upon which this disclosure is based and that it may readily be utilized as a basis for designing other structures, methods and systems for carrying out the several purposes of the invention. It is also to be understood that the abstract is neither intended to define the invention of the application, which is measured by the claims, nor to limit its scope in any way.

This summary and these objectives of the invention, along with the various features of novelty which characterize the invention, are pointed out with particularity in the claims annexed to and forming a part of this disclosure. For a better understanding of the invention, its operating advantages and the specific objects obtained by its use, reference should be made to the accompanying drawings and descriptive matter in which like characters of reference designate like parts throughout the several views.

DETAILED DESCRIPTION OF THE PREFERRED EMBODIMENT

Figure 1:
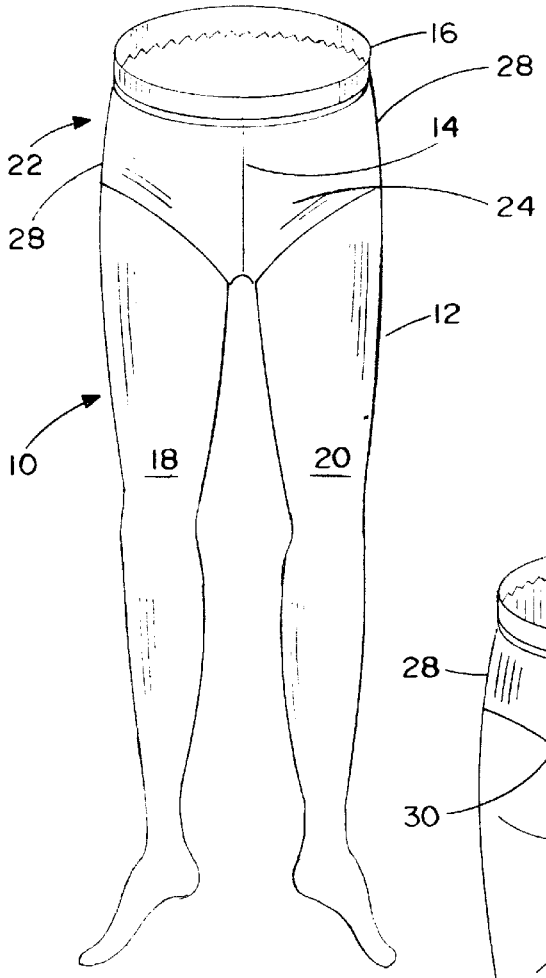
FIG. 1 is a frontal view of the panty pantyhose combination garment comprising the present invention as seen on a wearer displaying the arcuately shaped panty leg profile.
Figure 2:
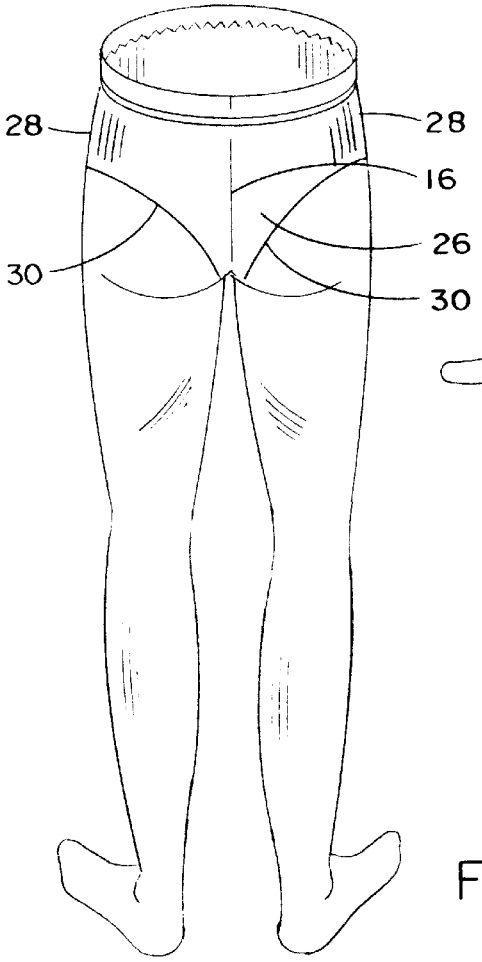
FIG. 2 is a back view of the garment of FIG. 1.
Figure 3:
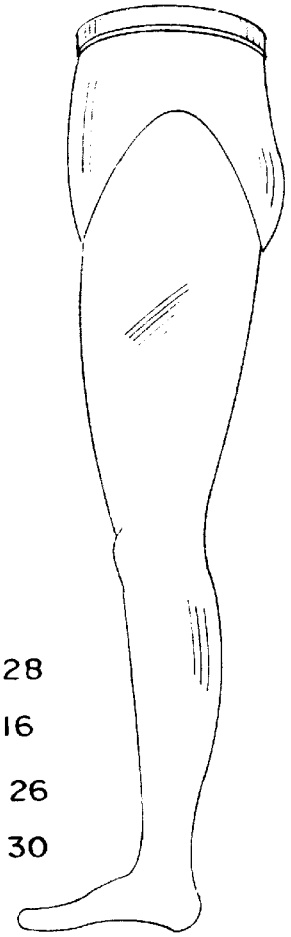
FIG. 3 is a side view of the garment shown in FIGS. 1 and 2.
Figures 4, 5, 6, 7, 8:
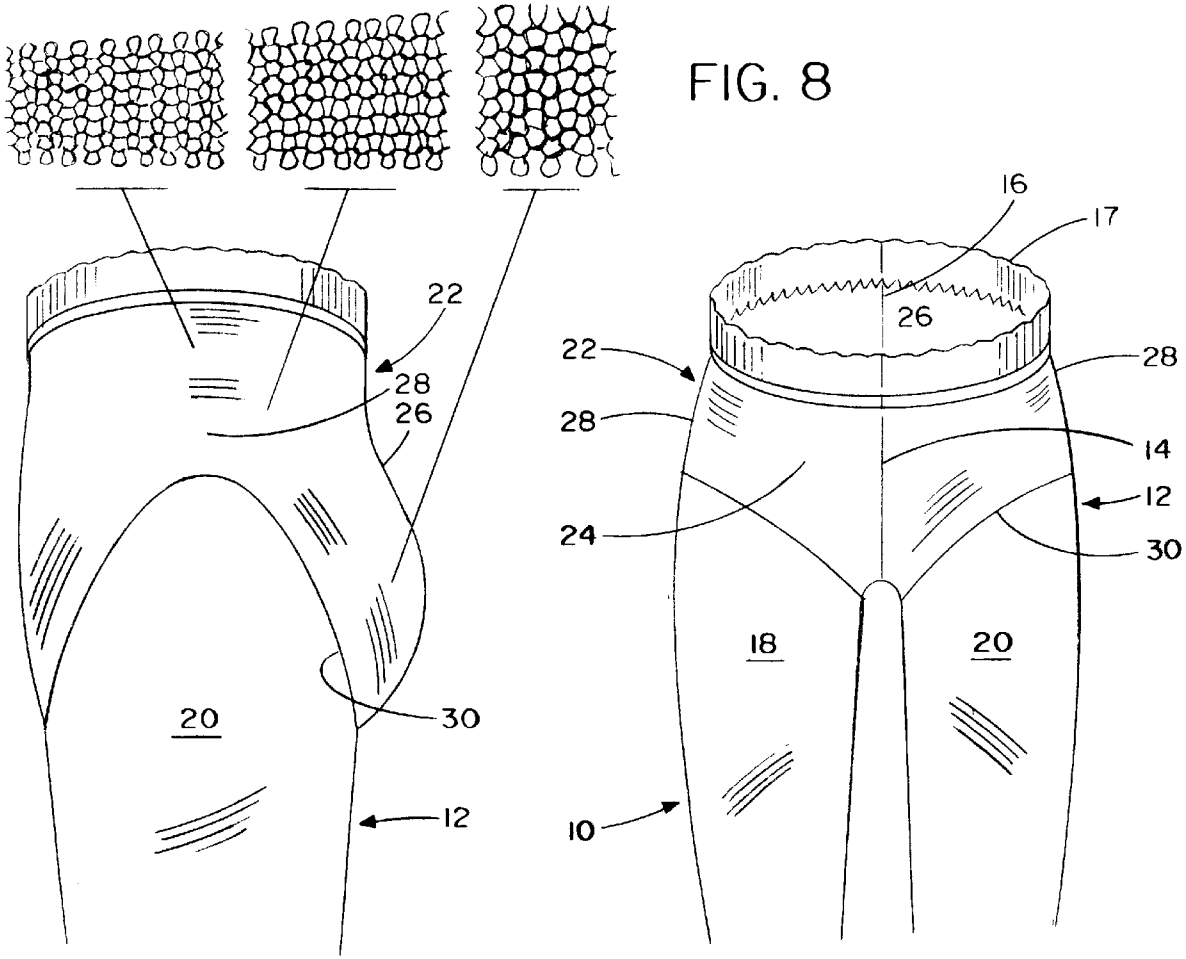
FIG. 4 is a side elevational, fragmentary view of the garment forming the present invention illustrating the arcuately shaped panty brief profile line.
FIG. 5 is a front fragmentary view of the garment shown in FIG. 4.
FIG. 6 is a highly magnified small area taken from the lateral area of the garment where the stitch lengths are shorter than anywhere else in the garment.
FIG. 7 is a highly magnified small section of the fabric of the present invention taken at a location between the lateral portion and rear portion of the garment.
FIG. 8 is a highly magnified small section of the fabric taken at the rear section of the garment where the stitch lengths are longest.
Figure 9:
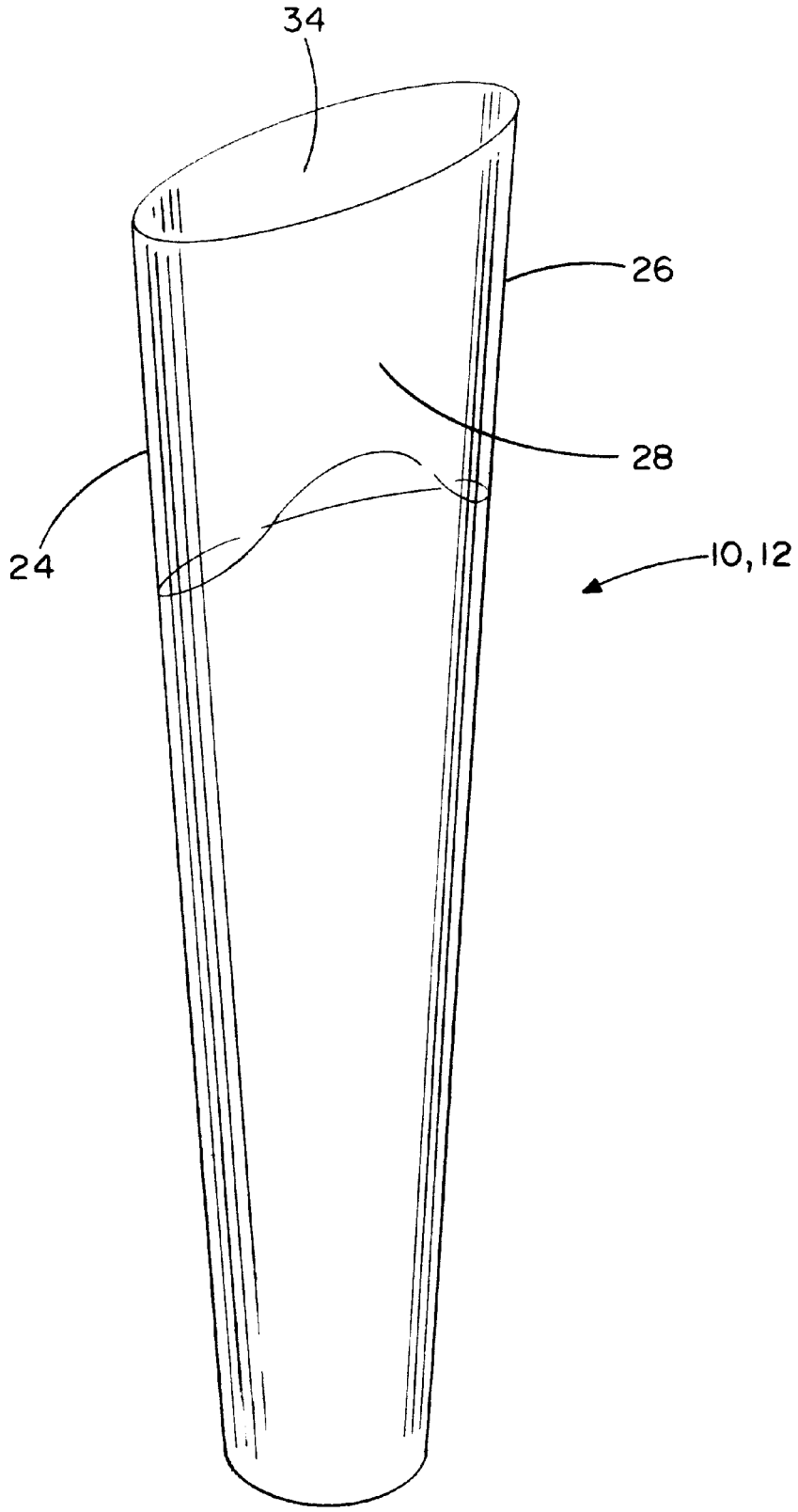
FIG. 9 is a perspective view of a tubular knit blank used to form the garment of the present invention.

Referring now to the drawings, FIGS. 1–3 illustrate the primary embodiment of the panty pantyhose combination garment incorporating a part of the present invention which includes two seamless circularly knit tubes 10, 12 with the upper part of each tube being slit downwardly to provide an edge 14 along the front of tubes 10, 12 and an edge 16 along the rear of tubes 10, 12. The edges are joined to form a seam at the front and at the rear of the garment. A crotch portion or gusset may or may not be included.

An elastic band 17 serves as a waistband for the garment, and leg portions 18, 20 extend downwardly from the lower part of the panty garment.

A panty section shown generally as 22 has a front panty portion 24, a rear panty portion 26 and lateral portions 28 spaced between the front and rear panty parts 24, 26. The joined front panty portion, lateral portions and rear panty portion have a multiplicity of courses of knitting, each course having knitted stitches of predetermined lengths. Each course of the garment is formed by having the largest stitches; i.e., those having the longest stitch length, occur in front and rear panty portions 24, 26. As the courses continue to be formed on the knitting machine in a circular fashion, the courses starting at front panty portion 24 are gradually reduced in length until they are at their shortest length at the approximate center of lateral portion 28. From that point, the course continues and the stitch length is increased gradually until it again reaches the length of the stitches in rear panty portion 26.

A yarn change takes place during the knitting operation when knitting stops in panty section 22 and commences in legs 18, 20. A heavier denier yarn is normally used for panty section 22 while a lighter denier yarn is used for legs 18, 20 to provide a sheer fashion leg covering. The yarn change line 30 would normally form a trunk or straight line effect if the stitch lengths of all of the stitches in all of the panty portion courses remained equal. This is the traditional way of manufacturing a standard pantyhose garment.

The present invention brings about a significant change in the appearance of the garment along yarn change line 30 since the shorter stitches in lateral portions 28 (FIG. 6) tighten up that part of the garment and raise the panty section in lateral portion 28 and fashion the yarn change line 30 arcuately as shown in FIGS. 1–5. The longer or looser stitches that are positioned in front and rear panty portions 24, 26 result in larger stitch lengths, thus resulting in the longest part of the panty portion occurring at the crotch area in front and rear panty portions 24, 26. Since the stitches are graduated from loose stitches in the crotch area to tight stitches in lateral portion 28, an arcuate yarn change line 30 occurs, thus simulating a pair of panties. This change is significantly magnified when a quite different yarn (other than nylon, for example) is used in the panty portion 22.

The method forming a part of the present invention includes forming two separate tubular members 10, 12 by making a first tubular portion from a first yarn for encircling the waist and torso of the wearer with a multiplicity of courses of knitting forming a front panty portion 24, a rear panty portion 26, an outside (lateral) portion 28 and a joining portion 34 with each course having knitted stitches of a predetermined length. The stitch lengths in outside portion 28 are smaller than the stitch lengths in rear, joining and front portions 24, 26, 34, this being accomplished by continuously graduating the stitches from the larger stitches in the front and rear portions 24, 26 downwardly to the smaller stitches in outside portion 28. After tubes 10, 12 are knit, they are slit along a portion of their length within joining section 34 to form slit edges and the slit edges are joined to form a pantyhose garment.

Yarn change line 30 arises from the abrupt change of the panty yarn, a heavier denier yarn, to the leg yarn, a lower denier yarn. While the change takes place, there still remains only a single layer of yarn over the lower torso, the heavier yarn of panty section 22 covering the lower torso and the lighter leg yarn covering the legs and feet.

Thus the shortened stitches on the outer portion of each tubular member in the panty portion produces a shorter vertical distance from waistband to bottom of the panty along yarn change line 30. The graduation of length of stitch from the longest to the shortest and back again is programmable along a smooth transition to provide a smooth arcuate line 30 at the bottom of the panty.

Should an even higher rise be desired in outside portion 28 of the panty, longer stitches could be used on the upper or lateral part of the leg portion of the tubular member, thus allowing the outside of the panty to rise even a greater distance.

In summary, the invention provides a new construction for forming a hosiery blank and pantyhose therefrom and for utilizing a method therefor that includes graduation technology to give an arcuate brief profile line utilizing a single layer of yarn, thereby providing a garment of superior fit and appearance.

In the drawings and specification, there has been set forth the best mode presently contemplated for the practice of the present invention. Although specific terms are employed, they are used in the generic and descriptive sense only and not for purposes of limitation, the scope of the invention being defined in the claims.

What is claimed is:

1. A panty pantyhose combination garment having a waist portion formed from a pair of circularly knit tubes of yarn disposed in a side-by-side relationship and slit at least along part of their length and joined at pairs of the edges thus formed to provide a panty section with a front panty portion extending generally downwardly from the waist portion to the joined edges and a rear panty portion extending downwardly from the waist portion to the joined edges, and two lateral portions each extending downwardly from the waist portion and between the front panty portion on one side and the rear portion at that side, the joined panty front and rear portions and the lateral portions having a multiplicity of courses of knitting, each course having knitted stitches of predetermined length, the knitted stitch length in the lateral portions being shorter than the knitted stitch lengths in the front and rear panty portions so that panty section has an arcuately shaped profile within the lateral portions.

2. The garment as claimed in claim 1 wherein the panty section has a single layer of yarn.

3. The garment as claimed in claim 1 wherein the stitch lengths in the lateral portions decrease from front portion to the approximate center of this lateral portion and increase therefrom until joining the rear portion.

4. The garment as claimed in claim 2 wherein the stitch lengths in the lateral portions decrease from front portion to the approximate center of the lateral portion and increase therefrom until joining the rear portion.

5. The garment as claimed in claim 1 further comprising leg portions extending from the front, rear and lateral portions for encompassing the legs and feet of a wearer.

6. The garment as claimed in claim 5 wherein the yarn in the front, rear and lateral portions differs from the yarn in the leg portions.

7. The garment as claimed in claim 5 wherein the yarn in the front, rear and lateral portions is of a higher denier than the yarn in the leg portions.

8. The garment as claimed in claim 6 wherein the yarn in the front, rear and lateral portions is a higher denier than the yarn in the leg portions.

9. The garment as claimed in claim 1 wherein the stitch length in each course of the lateral portions is graduated from the stitch length of the front portion downwardly to smaller stitch lengths at approximately the center of the lateral portions and then upwardly to larger lengths in the back portion.

10. The garment as claimed in claim 5 wherein the stitch length in each course of the lateral portions is graduated from the stitch lengths of the front portions downwardly to smaller lengths at approximately the center of the lateral portions and then upwardly to longer lengths in the back portion.

11. The garment as claimed in claim 10 wherein the yarn in the front, rear and lateral portions differs from the yarn in the leg portions.

12. The garment as claimed in claim 10 wherein the yarn in the front, rear and lateral portions is of a higher denier than the yarn in the leg portions.

13. The garment as claimed in claim 10 wherein the yarn in the front, rear and lateral portions differs from the yarn in the leg portions and is of a higher denier than the yarn in the leg portions.

14. A panty garment having a waist portion formed from a pair of circularly knit tubes of yarn disposed in the side-by-side relationship and slit at least along part of their length and joined at pairs of the edges thus formed to provide a panty section with a front panty portion extending generally downwardly from the waist portion to the joined edges and a rear panty portion extending downwardly from the waist portion to the joined edges, and a pair of lateral portions each extending downwardly from the waist portion between a front portion on one side and a rear portion at that side, the joined panty front and rear portions and the joined lateral portions having a multiplicity of courses of knitting, each course having similar and continuous knitted stitches of predetermined length, the knitted stitch lengths varying from the front portion through the lateral portions into the rear portion to configure a brief panty profile.

15. The garment as claimed in claim 14 wherein the panty section has a single layer of yarn.

16. The garment as claimed in claim 14 wherein the stitch lengths in the lateral portions decrease from the front portion to the approximate center of each lateral portion and increase therefrom until joining the rear portion.

17. The garment as claimed in claim 15 wherein the stitch lengths in the lateral portions decrease from the front portion to the approximate center of the lateral portion and increase therefrom until joining the rear portion.

18. A seamless knit hosiery blank comprising: a first tubular portion having a first yarn with a multiplicity of courses of knitting forming a front portion, a rear portion, a lateral portion and a joining portion with each course having knitted stitches of predetermined lengths, the knitted stitch lengths in the lateral portion being shorter than the knitted stitch lengths in the front, rear and joining portions; and a second tubular portion having a second yarn and forming a leg section.

19. The blank as claimed in claim 18 wherein the yarn in the first tubular portion is of a higher denier than the yarn in the second tubular portion.

20. A method of forming a knitted panty pantyhose combination garment comprising the steps of: forming two separate tubular members, each of the members being formed by making a first tubular portion from a first yarn for encircling the waist and torso of a wearer with a multiplicity of courses of knitting forming a front portion, a rear portion, a lateral portion and a joining portion with each course having knitted stitches of predetermined lengths, graduating the stitches of each course so that the stitch lengths in the lateral portion are smaller than the stitch lengths in the rear, joining and front portions; knitting leg and feet portions in each of the tubes from a different yarn; slitting the tubular members along a portion of their length within the joining portions to form slit edges; and joining the slit edges to form a pantyhose garment.

21. The method as claimed in claim 20 wherein the yarn and the first tubular portion is of a higher denier than the yarn of the feet and leg portions.

22. The method as claimed in claim 20 wherein the panty section has a single layer of yarn.

23. The method as claimed in claim 20 wherein the first and second tubular portions have a single layer of yarn.

* * * * *